United States Patent [19]

Roberts

[11] Patent Number: 4,536,680

[45] Date of Patent: Aug. 20, 1985

[54] RESISTIVE LAMP BALLAST WITH RE-IGNITION CIRCUIT

[75] Inventor: Victor D. Roberts, Burnt Hills, N.Y.

[73] Assignee: General Electric Company, Schenectady, N.Y.

[21] Appl. No.: 652,249

[22] Filed: Sep. 20, 1984

Related U.S. Application Data

[63] Continuation of Ser. No. 401,506, Jul. 26, 1982, abandoned.

[51] Int. Cl.[3] ..... H01J 7/44; H05B 37/02

[52] U.S. Cl. ..... 315/49; 315/176; 315/179; 315/185 R; 315/307; 315/58

[58] Field of Search ..... 315/49, 176, 179, 185, 315/307

[56] References Cited

U.S. PATENT DOCUMENTS

| | | | |
|---|---|---|---|
| 4,331,905 | 5/1982 | Owen | 315/225 |
| 4,340,843 | 7/1982 | Anderson | 315/49 |
| 4,350,929 | 9/1982 | Katoogi | 315/49 |
| 4,356,433 | 10/1982 | Linden | 315/308 |
| 4,376,911 | 3/1983 | Kaneda | 315/176 |
| 4,471,268 | 9/1984 | Brown et al. | 315/179 |
| 4,484,107 | 11/1984 | Kaneda | 315/176 |

*Primary Examiner*—Harold Dixon

*Attorney, Agent, or Firm*—Mark L. Mollon; James C. Davis, Jr.; Marvin Snyder

[57] ABSTRACT

A discharge lamp is provided with a resistive ballast together with means for sensing lamp voltage conditions. If the lamp voltage exceeds a predetermined threshold then a control circuit operates to apply the output of a relatively high frequency oscillator to the lamp to achieve lamp re-ignition which must be accomplished twice during each alternating current cycle. Lamp re-ignition is necessitated by lamp current zero-crossing which occurs as a result of powering the lamp from an alternating current energy source.

2 Claims, 2 Drawing Figures

RESISTIVE LAMP BALLAST WITH RE-IGNITION CIRCUIT

This application is a continuation of application Ser. No. 401,506, filed July 26, 1982, now abandoned.

BACKGROUND OF THE INVENTION

This invention relates to ballasts for discharge lamps operated from alternating current line sources. More particularly, the present invention relates to a resistive lamp ballast operating together with means for sensing lamp voltage and means for applying the output of an oscillator circuit to the lamp to effect lamp re-ignition.

For proper operation, discharge lamps require a current limiting or regulating device electrically connected between the lamp and the electrical energy source for the lamp. The most ubiquitous and available source of lamp energy is the conventional 50 or 60 cycle alternating current voltage present at conventional electrical outlets. Discharge lamps conventionally "see" this electrical power source as a source of constant voltage. Moreover, once lit, the resistance exhibited by a discharge lamp falls off with increasing lamp current. Thus, such lamps are not self-ballasting like conventional incandescent lamps whose resistance increases with filament current. Accordingly, for discharge lamps a current limiting device is required. This ballasting device may be an inductor, capacitor, resistor or an appropriately designed electronic circuit. However, the resistive ballast has a significant advantage of having a very low cost and is, accordingly, desirable for many discharge lamp applications.

Furthermore, because of the wide-spread availability of 50 or 60 Hz alternating current power, it is, accordingly, desirable to be able to operate discharge lamps directly from such an electrical energy source. However, when operated on alternating current directly, discharge lamps extinguish twice each cycle at those points in time at which the lamp current goes to zero. Inductive ballasts aid in the re-ignition of discharge lamps operated under alternating current conditions, since they provide a voltage spike each time the lamp current drops to zero. This voltage is phased so that it adds to the line voltage. However, resistive ballasts are generally considered undesirable for alternating current operation since they cannot provide voltage spikes which may be employed for lamp re-ignition. Therefore, in resistive ballast circuits operating from alternating current lines, lamp re-ignition voltage is limited by the available line voltage. However, the re-ignition voltage of certain lamps, such as miniature arc lamps, may be higher than the available line voltage. One such miniature arc discharge lamp is the Halarc lamp which is currently preferably operated from a direct current power supply since this eliminates the need to re-ignite the lamp twice during each alternating current cycle. However, direct current operation in such lamps can create cataphoretic effects which may have an adverse effect on lamp color as a function of lamp operating position. Therefore, it is also desirable to be able to operate this lamp and other discharge lamps directly from alternating current sources. Additionally, as discussed above, it is also desirable to operate such lamps using a resistive ballast. However, in such situations, means must be provided to ensure lamp re-ignition during conditions of zero current.

SUMMARY OF THE INVENTION

In accordance with a preferred embodiment of the present invention, a ballast for a discharge lamp comprises a resistive element for connection in series with the lamp, means for sensing voltage across the lamp, an oscillator for supplying re-ignition energy and means for coupling the re-ignition energy to the lamp under specified conditions of lamp current or voltage. In one embodiment of the present invention, the resistive ballast may be provided, at least in part, by a conventional lamp filament. In the present invention, whenever the lamp voltage exceeds a predetermined value, logic circuitry applies the oscillator output voltage to the discharge lamp, preferably by means of a high frequency transformer whose secondary is connected in series with the discharge lamp.

Accordingly, it is an object of the present invention to provide a resistive ballast for discharge lamps operating from alternating current voltage sources.

Additionally, it is an object of the present invention to provide a ballast to permit operating discharge lamps with alternating current voltage sources.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
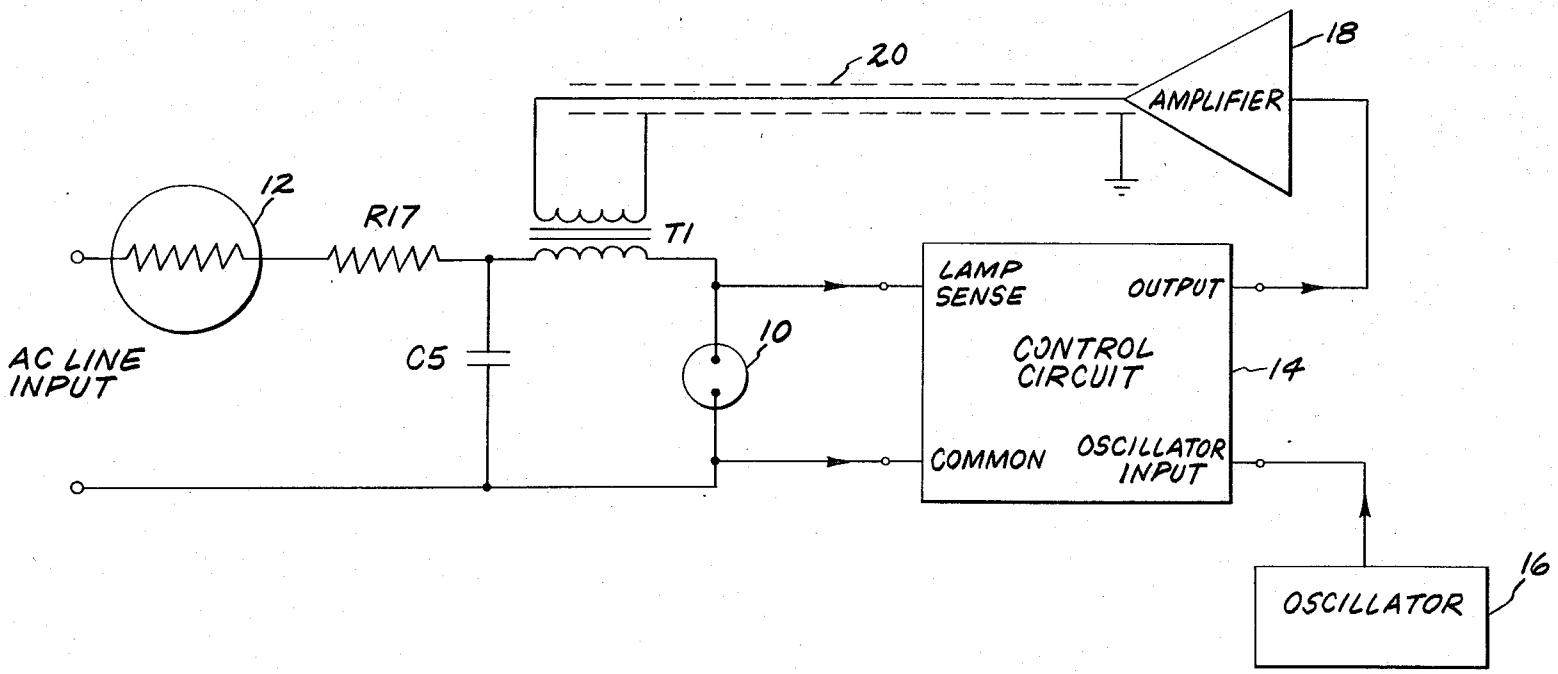
FIG. 1 is a schematic diagram illustrating one embodiment of the present invention.

The block diagram schematic shown in FIG. 1 is particularly useful for understanding the operation and construction of the present invention. In this circuit, discharge lamp 10, comprising, for example, a miniature arc discharge lamp, is resistively ballasted with the combination of filament 12 and resistor R17. Discharge lamp 10, filament 12 and resistor R17 are connected in series. R17 may be eliminated if filament 12 is constructed so as to have an appropriate resistance. Filament 12 typically comprises a conventional incandescent lamp filament and operates to provide visible light output during the time that discharge lamp 10 is warming up. Accordingly, filament 12 and discharge lamp 10 are typically found contained within the same envelope as part of an integral lamp structure. Additionally, the secondary winding of transformer T1 is also connected in series with discharge lamp 10, resistor R17 and filament 12. It is through the secondary winding of T1 that re-ignition energy is supplied to discharge lamp 10 during zero current transition times. The frequency of the electrical re-ignition energy waveform is generally selected to be significantly in excess of the alternating current line input voltage which is typically either 50 or 60 Hz. In particular, successful experiments of the present invention have been carried out using a re-ignition energy frequency of approximately 200 KHz. Accordingly, transformer T1 may be constructed with a primary winding comprising about 50 turns of No. 30 wire around a ferrite core such as core 2616/A160/3B7 as supplied by the Ferroxcube Corporation of Saugerties, N.Y. Additionally, the secondary winding of transformer T1 may comprise approximately 300 turns of No. 30 insulated wire also wound around the ferrite core. Additionally, capacitor C5 may be disposed across lamp 10 and the secondary winding of transformer T1. Capacitor C5 operates as a high frequency bypass capacitor and is selected to have a capacitive value such that its impedance at the re-ignition energy frequency is relatively low, while at a frequency of approximately 50 or 60 Hz it is relatively high. In particular, a capacitor with a capacitance value of approximately 0.5 microfarads may be employed.

During times at which the current through discharge lamp 10 is zero, the voltage that appears across lamp 10 is generally almost equal to the input line voltage. It is at these times that re-ignition energy is supplied to lamp 10 by the circuit of the present invention. In order to determine the timing for this re-ignition energy to be applied, it is necessary to provide a circuit which responds either to the voltage or current conditions across or through, respectively, lamp 10. For example, re-ignition energy may be applied to lamp 10 whenever the voltage across lamp 10 exceeds a predetermined threshold value. Such a circuit is shown in FIG. 1. In the embodiment illustrated in FIG. 1, it is the voltage condition which is used to determine the timing for triggering the application of a re-ignition voltage to the lamp. In particular, control circuit 14 operates to connect oscillator 16 to amplifier 18 under appropriate lamp conditions. Amplifier 18 then supplies a relatively high frequency signal along shielded cable 20 to the primary winding of transformer T1. Control circuit 14 operates to provide a higher voltage supply for the arc tube for a preset period of time. This preset period is typically selected to be less than ½ cycle of the power line frequency, so that the re-ignition cycle is repeated each half cycle of the input power waveform, as required.

It should be particularly noted that the operation of the present invention offers several significant advantages for lamp operation. In particular, it should be noted that in its contemplated mode of operation, the ballast of the present invention observes the lamp voltage during each half cycle of applied alternating current voltage to determine during each half cycle whether or not it is necessary to apply a re-ignition voltage to the discharge lamp. It should also be noted that several types of discharge lamps which are employable with the present invention exhibit a characteristic warm-up time of between about 5 and about 20 seconds, generally depending on lamp size, during which time re-ignition voltages are particularly useful in reestablishing a discharge current through the ionizable medium. Furthermore, certain lamps exhibit characteristics during their first few hours of operation in which certain lamp impurities are "cleaned up" or neutralized. Depending upon lamp size, lamp construction, electrode material, and the specific nature of the ionizable medium, various lamps exhibit different needs for this early clean-up cycle. However, the ballast of the present invention is particularly advantageous in that requisite re-ignition voltages are applied to lamps requiring this clean-up, only as is necessary during lamp warm-up or clean-up cycles. Lastly, it is not uncommon for the alternating current power line supplying the lamp to exhibit voltage fluctuations. During such fluctuations when the line voltage is lower than normal, lamp re-ignition can be a particularly difficult problem. However, this problem is significantly mitigated in the present invention since re-ignition voltages would be applied during such conditions of low line voltage. Thus, the ballast and lamp of the present invention would continue to operate as long as tolerable levels of power line voltage were present. Accordingly, the automatic compensation advantages of the present ballast and lamp should therefore be particularly noted.

Figure 2:
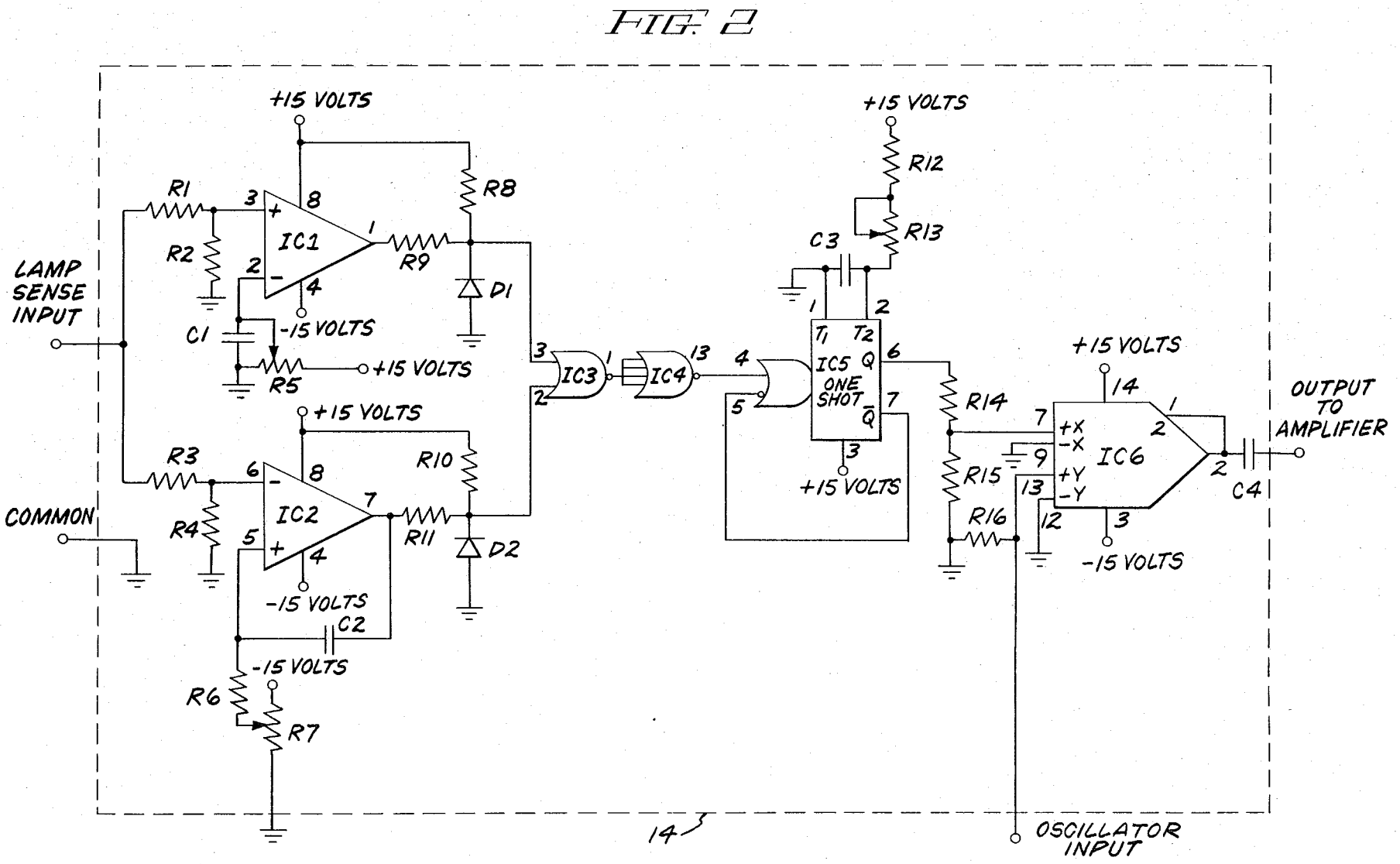
FIG. 2 is a schematic circuit diagram more particularly illustrating a possible embodiment for the control circuit of FIG. 1.

FIG. 2 illustrates one possible configuration for an appropriate control circuit 14 for operation of the present invention. It is, however, to be noted that the circuit shown was constructed using available components in order to test the functioning of the present invention and is not intended as illustrating a preferred embodiment. However, it should be noted that in a preferred embodiment, a triggerable power oscillator is employed to provide the necessary, temporary re-ignition voltage. Similarly, the multiplier circuit shown and discussed below would not be the preferred implementation to achieve a gating function but was employed for convenience. Likewise, the amplifier function is preferably incorporated in a power oscillator having an appropriate voltage rating.

The sample circuit illustrated in FIG. 2 indicates a circuit employable for sensing and determining the threshold voltage across lamp 10. Control circuit 14 essentially functions as a comparator whose output is used to control a gate which permits the output of oscillator 16 to be applied to the input of amplifier 18. The circuit of FIG. 2 was constructed from a number of integrated circuits which are commercially available. In this regard, the numerals shown adjacent to the integrated circuit schematic symbols near to various input and output lines indicate the pin numbers which these integrated circuits employ. These numbers should not be mistaken for reference numerals nor for component values. The circuit of FIG. 2 actually includes two comparators whose outputs are applied to the two inputs of integrated circuit IC3. The upper comparator is used as a positive voltage level detector, while the lower comparator of FIG. 2 serves as a negative voltage level detector. Resistors R1, R2 and resistors R3 and R4 form a pair of voltage divider networks for each comparator which operate to provide an effective linear range of ±280 volts for the comparators. Variable resistors R5 and R7 are used to set the switching threshold for the comparators. Capacitors C1 and C2, together with resistor R6 are used to prevent high frequency oscillation. Resistors R8 and R9 and diode D1 are used to provide a 0 volt to +15 volt output from the upper comparator. Similarly, resistors R10 and R11, together with diode D2 provide a similar function for the lower comparator output from integrated circuit IC2. Specific resistance, capacitance and component designations are found listed in Table I.

The comparator outputs are combined in integrated circuit IC3 which provides a NOR logic function. The output of integrated circuit IC3 is provided to each of the inputs of integrated circuit IC4 which operates as an inverter. Accordingly, integrated circuits IC3 and IC4 function together in the circuit shown to provide a single OR logic function. In fact, integrated circuits IC3 and IC4 are available in a single package designated MC14002 as supplied by the Motorola Corporation of Shaumburg, Ill. The output of integrated circuit IC4 is used to trigger integrated circuit IC5 which is a retriggerable one-shot multi-vibrator connected as shown. Integrated circuit IC5 may be provided in a single package designated MC14528, also as provided by the Motorola Corporation of Shaumburg, Ill. In this particular circuit application, the retriggerable feature of the one-shot multi-vibrator is not desired. Accordingly, a connection is made from pin 7 to pin 5 of integrated circuit IC5 to prevent further triggering pulses from reaching the multi-vibrator after it has switched on. Resistors R12 and R13 together with capacitor C3 determine the length of time that the multi-vibrator signal remains in the on state. Resistors R14 and R15 reduce the 0 volt to +15 volt output signal from integrated circuit IC5 to a value between 0 volts and +10 volts for compatibility with the multiplier, implemented as integrated circuit IC6 which is available from Analog Devices, Inc. and having the designation AD532. The oscillator signal is connected to one input of multiplier IC6 while the "true" output of integrated circuit IC5 is connected to the other input. Accordingly, the oscillator signal is then present at the output of the multiplier whenever the one-shot multi-vibrator IC5 is active. Capacitor C4 is provided to block residual direct current signals from reaching amplifier 18.

When either the positive or the negative comparator detects that the arc tube voltage has exceeded a preset level, such as 100 volts, they activate the OR logic gate (IC3 and IC4), which triggers one-shot multi-vibrator IC5 which, in turn, activates multiplier IC6 and causes the amplifier to apply auxiliary power to discharge lamp 10 via transformer T1 for a preset period of time, such as approximately 4 milliseconds. This auxiliary power assists lamp 10 throughout its re-ignition phase and prevents lamp drop out.

TABLE I

| Component | Value/Designation |
|---|---|
| R1 | 1 MΩ |
| R2 | 51KΩ |
| R3 | 1 MΩ |
| R4 | 51KΩ |
| R5 | 100KΩ |
| R6 | 10KΩ |
| R7 | 100KΩ |
| R8 | 56KΩ |
| R9 | 56KΩ |
| R10 | 56KΩ |
| R11 | 56KΩ |
| R12 | 10KΩ |
| R13 | 100KΩ |
| R14 | 56KΩ |
| R15 | 100KΩ |
| R16 | 100KΩ |
| C1 | 0.1 μf |
| C2 | 51 pf |
| C3 | 1 μf |
| C4 | 0.1 μf |
| C5 | 0.5 μf |
| D1 | 1N916 |
| D2 | 1N916 |
| IC1 | ½MC3209 |
| IC2 | ½MC3209 |
| IC3, IC4 | MC14002 |

TABLE I-continued

| Component | Value/Designation |
|---|---|
| IC5 | MC14528 |
| IC6 | AD532 |

From the above, it should be appreciated that the ballast circuit of the present invention provides a relatively low cost means for operation of discharge lamps, particularly miniature arc tube lamps. The re-ignition circuit of the present invention provides the means necessary to operate discharge lamps using a simple inexpensive resistive ballasting element. Furthermore, the re-ignition circuit of the present invention provides a means of operating the lamp directly from a conventional alternating current power line.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A re-ignition circuit adapted to be connected to a discharge lamp, said discharge lamp being connected in series with a resistive element and being adapted to be coupled to an AC source, said re-ignition circuit comprising:

sensing means for sensing voltage across said lamp;

an oscillator coupled to said sensing means for supplying re-ignition energy across the electrodes of said lamp upon the condition during any half cycle of said AC source that said sensing means indicates that lamp voltage exceeds a predetermined value;

a transformer having one winding connected between said resistive element and said lamp and having its other winding connected to the output of said oscillator; and a high frequency bypass capacitor connected across the series combination of said one winding and said lamp.

2. A lighting system comprising:

a discharge lamp;

a resistive element coupled in series with said lamp and adapted to be coupled to an AC source;

sensing means for sensing voltage across said lamp;

an oscillator coupled across the electrodes of said sensing means for supplying re-ignition energy across the electrodes of said lamp upon the condition during any half cycle of said AC source that said sensing means indicates that lamp voltage exceeds a predetermined value;

a transformer having one winding connected between said resistive element and said lamp and having its other winding connected to the output of said oscillator; and a high frequency bypass capacitor connected across the series combination of said one winding and said lamp.

* * * * *